US006640684B2

(12) United States Patent
Betti

(10) Patent No.: US 6,640,684 B2
(45) Date of Patent: Nov. 4, 2003

(54) DEVICE FOR CUTTING BLISTER PACKS IN A BLISTER PACKING MACHINE

(75) Inventor: Claudio Betti, Imola (IT)

(73) Assignee: I.M.A. Industria Macchine, Bologna (IT)

( * ) Notice: Subject to any disclaimer, the term of this patent is extended or adjusted under 35 U.S.C. 154(b) by 22 days.

(21) Appl. No.: 09/850,249

(22) Filed: May 7, 2001

(65) Prior Publication Data

US 2002/0152865 A1 Oct. 24, 2002

(30) Foreign Application Priority Data

Apr. 23, 2001 (IT) ..... B02000A0269

(51) Int. Cl.[7] ..... B26D 3/14

(52) U.S. Cl. ..... 83/862; 83/214; 83/917; 83/870; 83/885; 156/193; 156/250; 493/56; 493/199; 493/299; 493/361

(58) Field of Search ..... 83/862, 870, 885, 83/214, 213, 946, 917; 156/153, 211, 250; 493/361, 56, 199, 229

(56) References Cited

U.S. PATENT DOCUMENTS 3,759,122 A 9/1973 Lane et al.
3,774,491 A * 11/1973 Killilea ..... 83/433
3,958,051 A * 5/1976 Smith ..... 428/42.3
4,003,300 A * 1/1977 Grobman ..... 493/365
4,253,364 A * 3/1981 Kiefer et al. ..... 83/217
4,312,255 A * 1/1982 Holmstrom ..... 83/582
4,317,399 A 3/1982 Romagnoli
5,337,639 A * 8/1994 Morrison ..... 83/111
6,085,624 A * 7/2000 Lever et al. ..... 83/13

FOREIGN PATENT DOCUMENTS

GB 2 184 086 A 6/1987
JP 52 121489 10/1977

* cited by examiner

*Primary Examiner*—Allan N. Shoap
*Assistant Examiner*—Phong Nguyen
(74) *Attorney, Agent, or Firm*—William J. Sapone; Coleman Sudol Sapone, P.C.

(57) ABSTRACT

In a device for cutting single blister packs from a blister band, a cutting member acts in a longitudinal direction with respect to the blister band, along the longitudinal edges thereof, so as to cut side extending strips of the blister band which extend beyond the length of the blister pack being produced. Cut out elements operate in alignment with a cutting line of the cutting member to cut shaped pieces of the blister band, so as to define corner zones of the blister packs. Shearing means operate crosswise to the blister band, in alignment with the corner zones defined by the cut out means, to separate single blister packs. The position of the cutting means and cut out means and/or the shearing means can be adjusted to produce blister packs having different sizes.

8 Claims, 6 Drawing Sheets

42
D
12
H1
13
11
A1
W
40
42
41

11
42
D
K1
12
41
13
A1
W
11
42
12

FIG. 3a
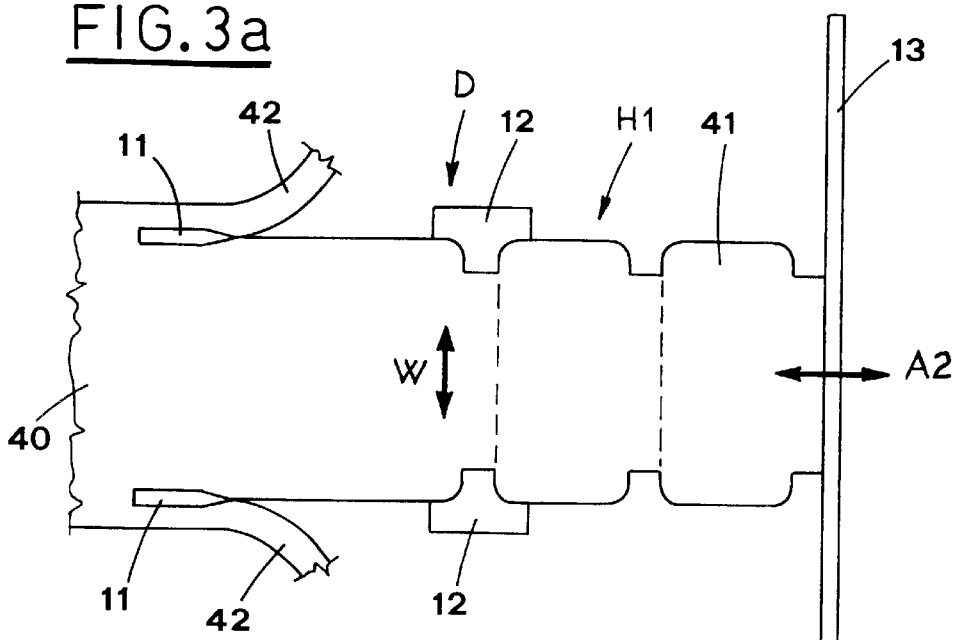
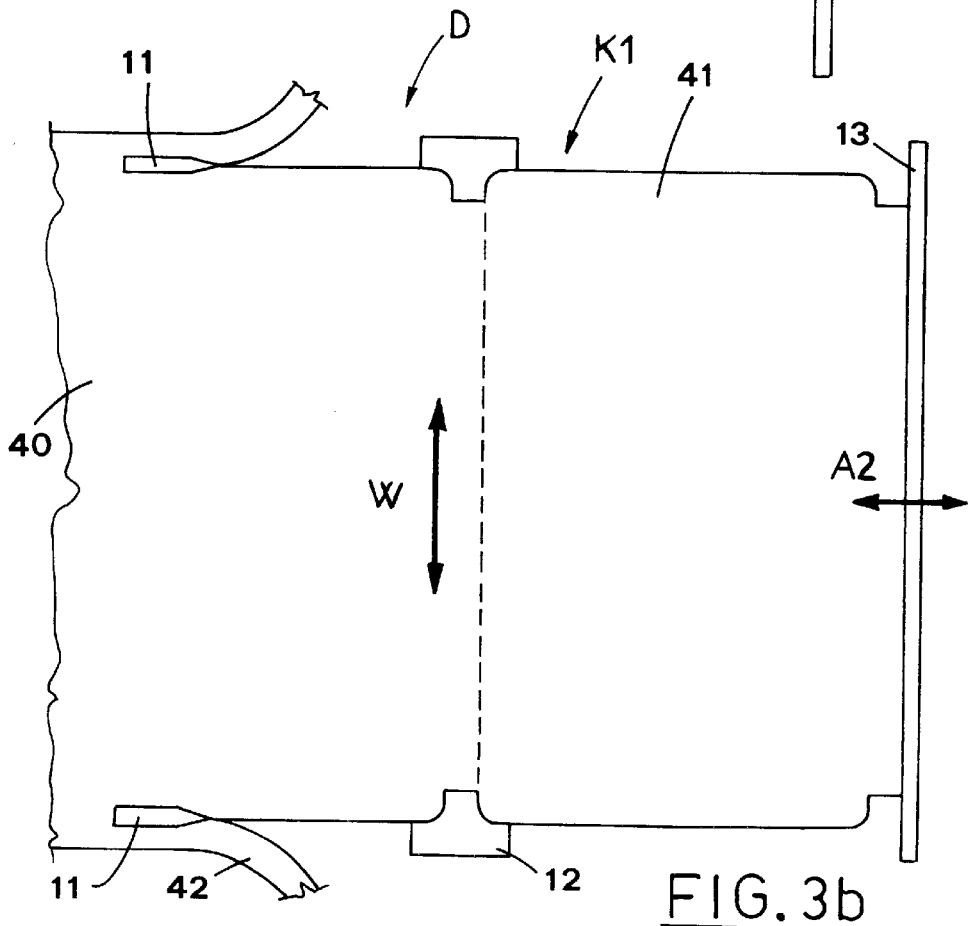
FIG. 3b

FIG.4a
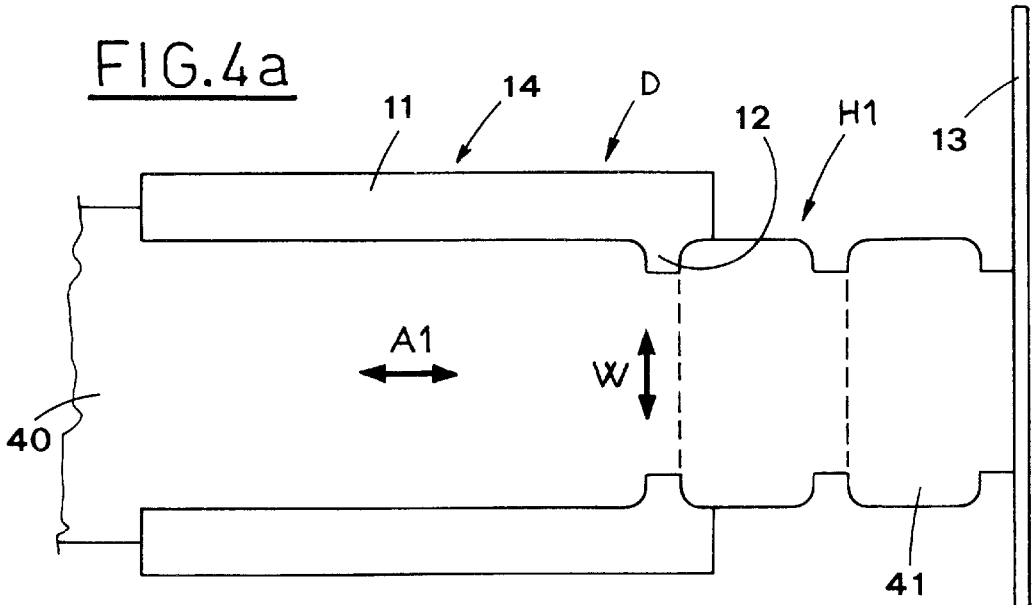
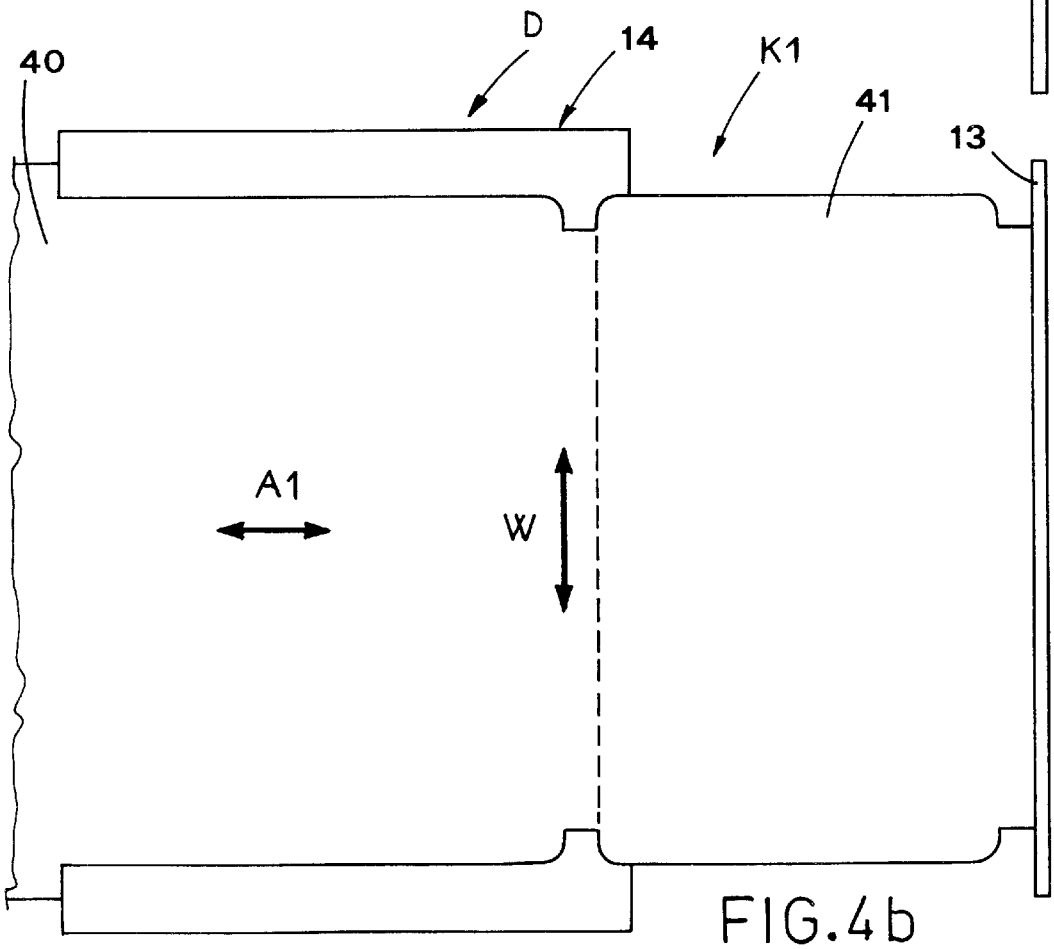
FIG.4b

FIG.5a
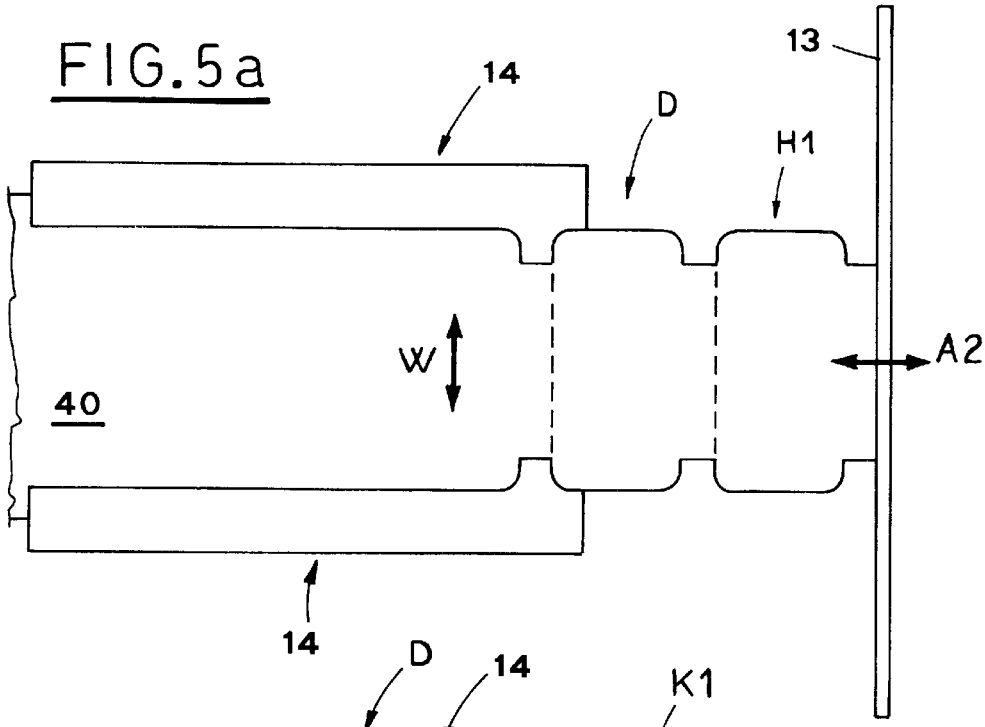
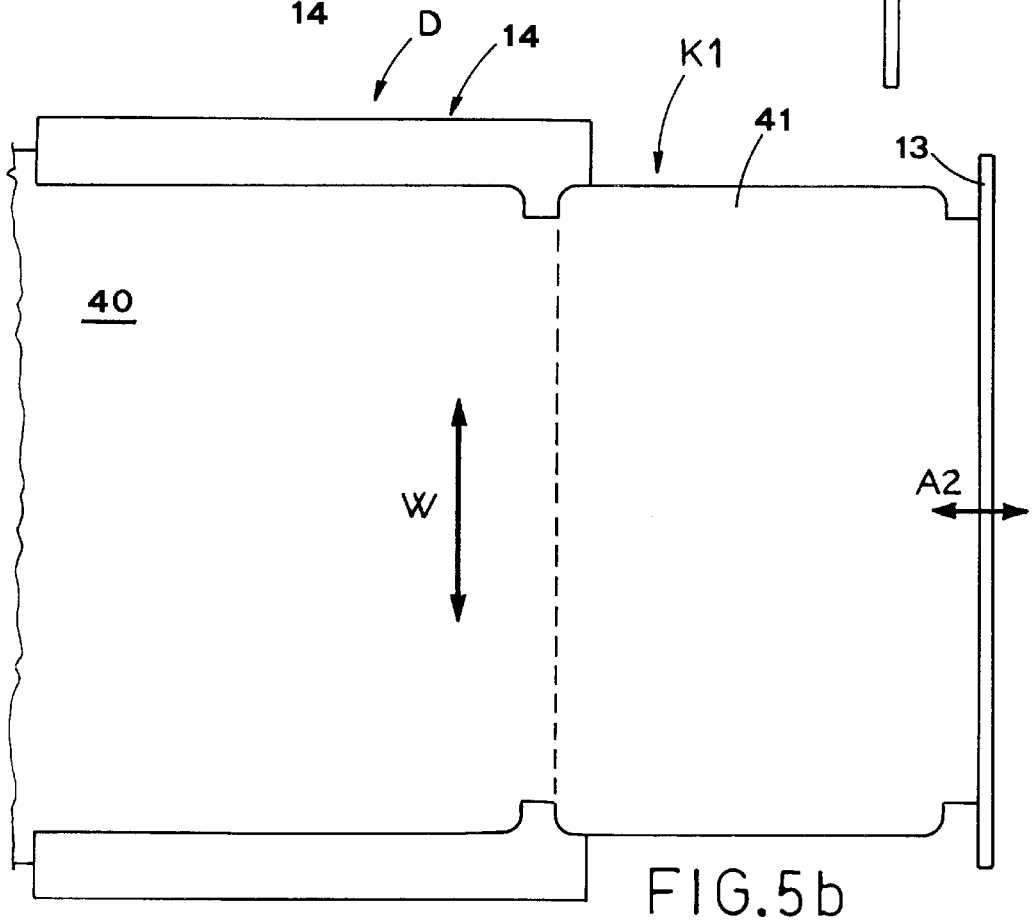
FIG.5b

DEVICE FOR CUTTING BLISTER PACKS IN A BLISTER PACKING MACHINE

BACKGROUND OF THE INVENTION

The present invention relates to production of blister packs. More particularly, the invention relates to a device for cutting single blister packs in an automatic blister packing machine.

DESCRIPTION OF THE PRIOR ART

Known blister packing machines produce automatically blister packs from a continuous band of heat-formable material. The known machines form an ordered series of blisters on the heat-formable band and fill the obtained blisters with articles. Afterwards, the blisters are closed hermetically with a sealing film, which is heat-welded to the blister band.

The blister band is cut in a subsequent shearing station, so as to obtain single blister packs, which are sent to a packaging machine.

The shearing station includes cutting means, formed substantially by a cutting punch which defines the outline of the blister to be obtained.

Consequently, such cutting means can form only one size of blister packs.

Currently, when the blister pack size is to be changed in the blister packing machines described above, it is necessary to substitute the whole group of cutting means in the shearing station.

This causes a long break in the production cycle, which results in a considerable costs increase.

Moreover, it is necessary to store in a magazine as many groups of cutting means as the blister pack sizes to be obtained.

SUMMARY OF THE INVENTION

The object of the present invention is to overcome the above problem by proposing a device for cutting blister packs, which allows to change blister size in blister packing machines easily and rapidly.

Another object of the present invention is to propose a cutting device, which is universal and can be used for any size included within the transversal dimension of the heat-formable band.

A further object of the present invention is to propose a cutting device, which is very simple to construct and functional.

The above mentioned objects are achieved, in accordance with the claims, by a device for cutting blister packs, with a selected crosswise dimension or length, from a blister band in a shearing station of a blister packing machine, with said blister band driven in a forward direction at the shearing station, the device including:

- cutting means which operate along side edges of said blister band to cut, along a cutting line, respective side strips of said blister band which go beyond said crosswise dimension, or length, of said blister packs being produced;
- cut out means for cutting shaped pieces of said blister band in alignment with said cutting line of said cutting means, to define corner zones of said blister packs; and
- shearing means acting crosswise on said blister band, in the region of said corner zones defined by said cut out means, for severing said blister packs;

the position of said cutting means and/or said cut out means and/or shearing means being adjustable to allow production of blister packs having different sizes.

BRIEF DESCRIPTION OF THE DRAWINGS

The characteristic features of the present invention will be pointed out in the following description of a preferred, but not only embodiment, with reference to the enclosed drawings, in which:

FIGS. 3*a*, 4*a*, 4*b* and 5*a*, 5*b* are plan views of different embodiments of the proposed cutting device, in operation configurations assumed for obtaining blisters of different size;

DESCRIPTION OF THE PREFERRED EMBODIMENTS

Figure 1:
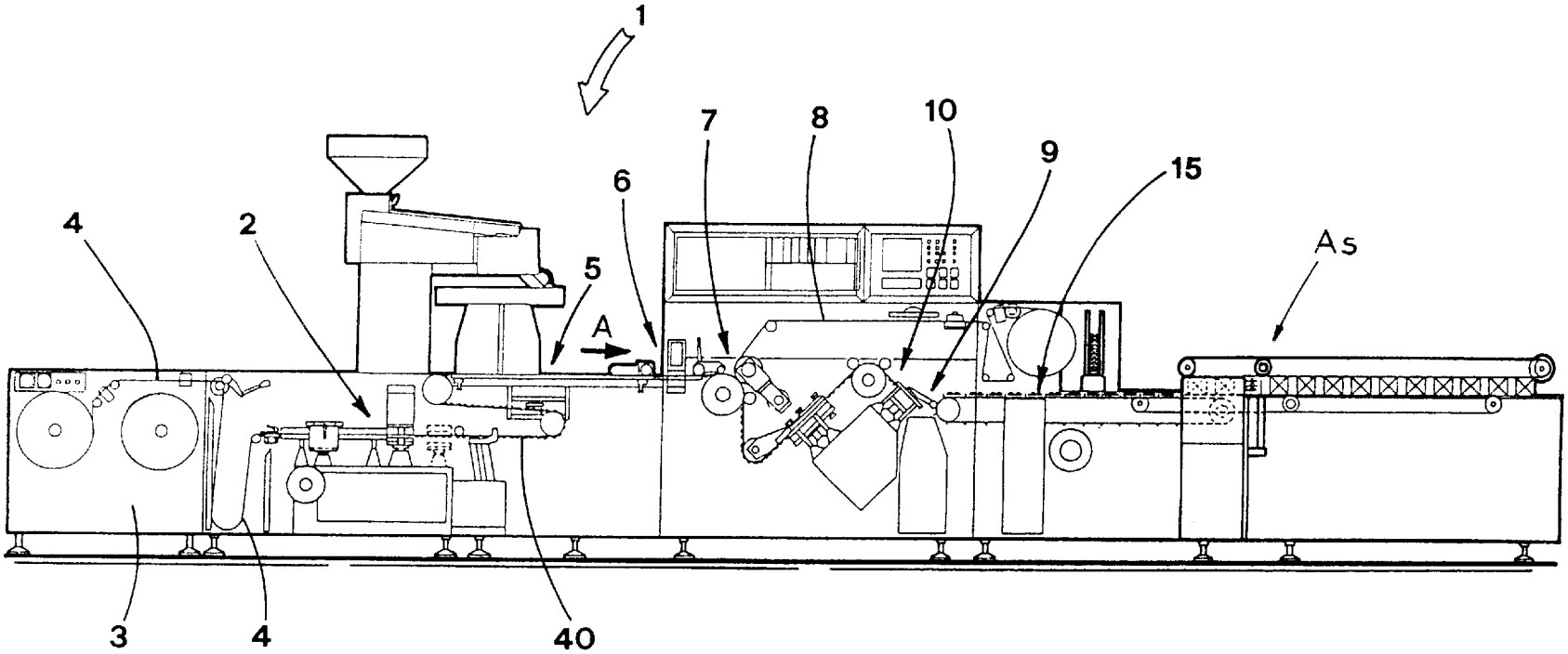
FIG. 1 is a lateral view of a blister packing machine equipped with the proposed cutting device, as a whole.

With reference to FIG. 1, the reference numeral 1 indicates a blister packing machine.

The blister packing machine 1 includes a heat-forming station 2, in which a plurality of blisters (not shown) are made from a band 4 of a heat-formable material, which extends along a moving path A on a frame 3.

Downstream of the heat-forming station 2, the so obtained blister band 40 enters a station 5, in which the blisters are filled with articles (not shown), and a station 6, in which the presence of the articles inside the blisters is checked. In a subsequent sealing station 7, the blisters are closed with a suitable sealing band 8, which is heat-welded with the blister band.

Subsequently, the blister band 40 passes to a shearing station 10, where single blister packs 41 are cut away from the blister band 40 (FIGS. 2*a*–5*b*).

The blister packs 41 are transferred, e.g. according to known techniques, by a known overturning device 9, to an inlet line 15 of a packaging machine AS, joined to the blister packing machine 1 in known way.

A cutting device D, working in the shearing station 10, is equipped with a plurality of co-operating cutting means, so as to define single blister packs 41.

More precisely, the cutting device D includes a first pair of cutting means 11, situated on the opposite sides of the blister band 40 and acting in a longitudinal direction with respect thereto, along the longitudinal edges thereof so as to cut respective side extending strips 42 of the blister band 40 which extend beyond the length of the blister pack 41 to be obtained (see FIGS. 2*a*, 2*b* and 3*a*, 3*b*).

The cutting means 11 include preferably a pair of stationary blades or rotating discs or like cutting elements.

The scraps formed by the lateral strips 42 of the band 40 can be eliminated by suction systems or by known winding systems (not shown).

A corresponding pair of cut out means 12 is situated downstream of the cutting means 11, along the blister band 40 movement path A.

The cut out means 12 operate in alignment with the cutting line of the cutting means 11 to cut shaped portions of the blister band 40, so as to define corner zones of the blister packs 41.

Practically, the cut out means 12 are aimed at cutting the blister packs 41 according to a suitable rounded profile and during an alternate movement crosswise to the blister band 40. It is to be noted that the cut out means 12 feature bilateral cutting edges, so as to define adjacent blister packs 41.

The portions of the band 40, cut out by the cut out means 12, are eliminated preferably by suction systems (not shown), like the scraps formed by the lateral strips 42.

Shearing means 13, situated downstream of the cut out means 12, include an alternate blade 13, which operates in the region of the corner zones defined by the cut out means 12, to separate single blister packs 41.

Figure 2A:
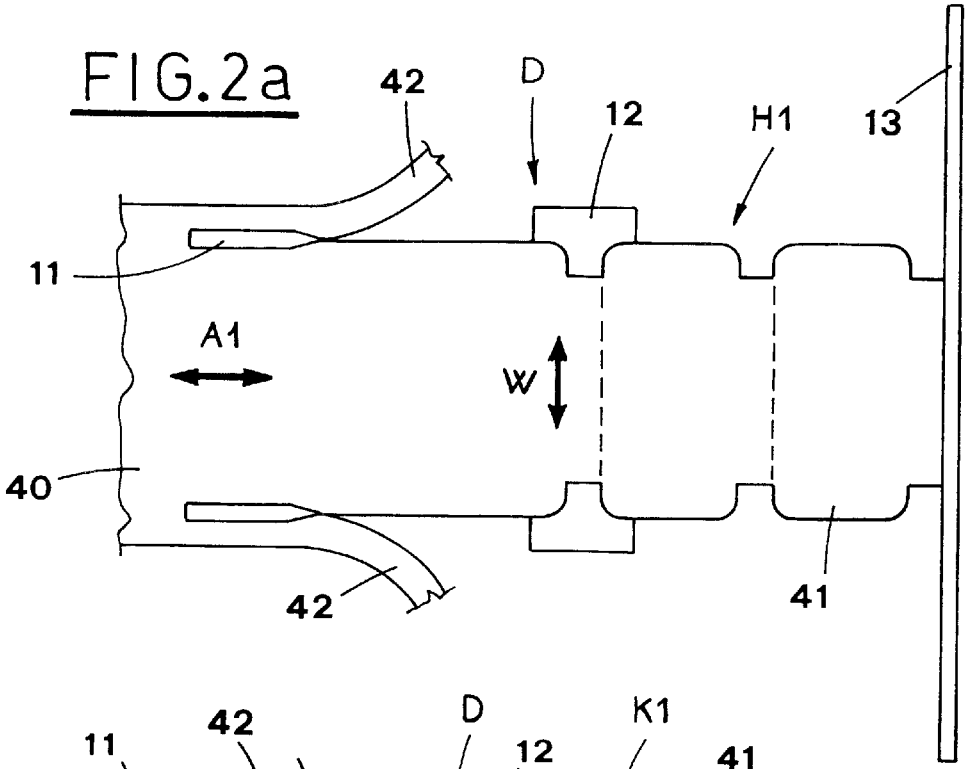
FIGS. 2*a* and 2*b* are plan schematic views of the proposed cutting device, in two operation configurations assumed for obtaining blisters of different size.
Figure 2B:
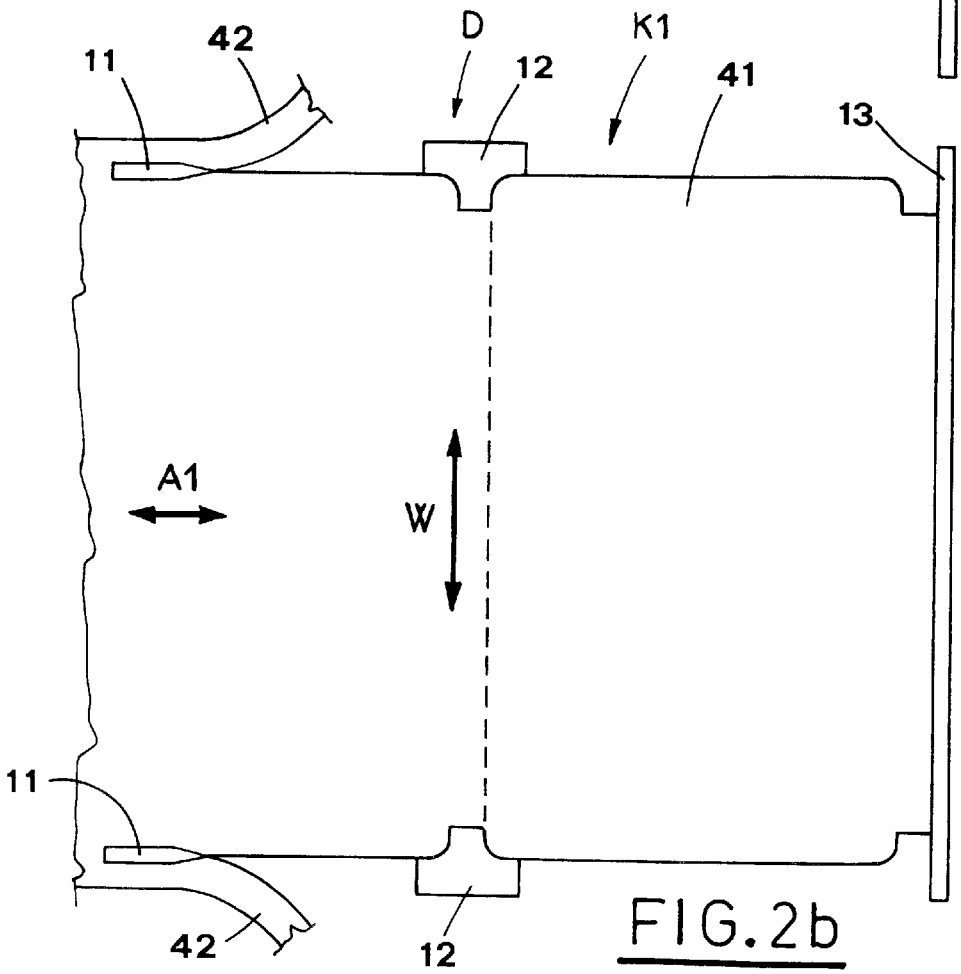

The blister packs 41 of different sizes can be obtained by the preferred embodiment of the proposed device D, according to which the position of the cutting means 11 and the cut out means 12 can be adjusted, i.e. they are mounted e.g. on a plate including sliding guides, known and not shown, which move crosswise and longitudinally to the blister band 40, as can be better seen in FIGS. 2*a* and 2*b*, which show the operation configurations H1, K1, corresponding e.g. to the smallest size of the blister packs 41 and the biggest one, respectively.

In other words, the movement of the cutting means 11 and the cut out means 12 in direction W, crosswise to the blister band 40, allows to adjust the crosswise dimension or length of the blister packs 41, while the lengthwise movement of the cutting means 11 and the cut out means 12 with respect to the blade 13, mounted stationary, in a direction A1, allows to adjust the lengthwise dimension or width of the blister packs 41.

The cutting means 11 and the cut out means 12 are carried on each longitudinal edge of the blister band 40 by one sliding member (not shown), which allows to adjust them contemporarily, preferably automatically.

FIGS. 3*a* and 3*b* show a different embodiment of the device D, in which the cutting means 11 and the cut out means 12 move only in the direction W, crosswise to the blister band 40, so as to change the crosswise dimension or the length of the blister packs 41.

The corresponding lengthwise dimension or width of the blister packs 41 is adjusted by moving the shearing blade 13, mounted moving lengthwise with respect to the blister band 40, e.g. on a plate with sliding guides, not shown, since known, in a direction A2.

According to another embodiment shown in FIGS. 4*a* and 4*b*, the cutting means 11 and the shearing means 12 include a unique alternate cutting member 14 for each side edge of the blister band 40.

The cutting member 14 can be moved in a direction W, crosswise with respect to the blister band 40 and lengthwise with respect to the blister band 40 in a direction A1, with respect to the stationary blade 13, so as to obtain blister packs 41 of different sizes H1, K1, in a way described above.

Obviously, also in this case the cutting member 14 can be mounted moving only in the direction W, crosswise with respect to the blister band 40, so as to change the crosswise dimension or the length of the blister packs 41, while the corresponding lengthwise dimension or width of the blister packs 41 is adjusted by moving the shearing blade 13, mounted moving in the direction A2, lengthwise with respect to the blister band 40, as better shown in FIGS. 5*a* and 5*b*.

Figure 6:
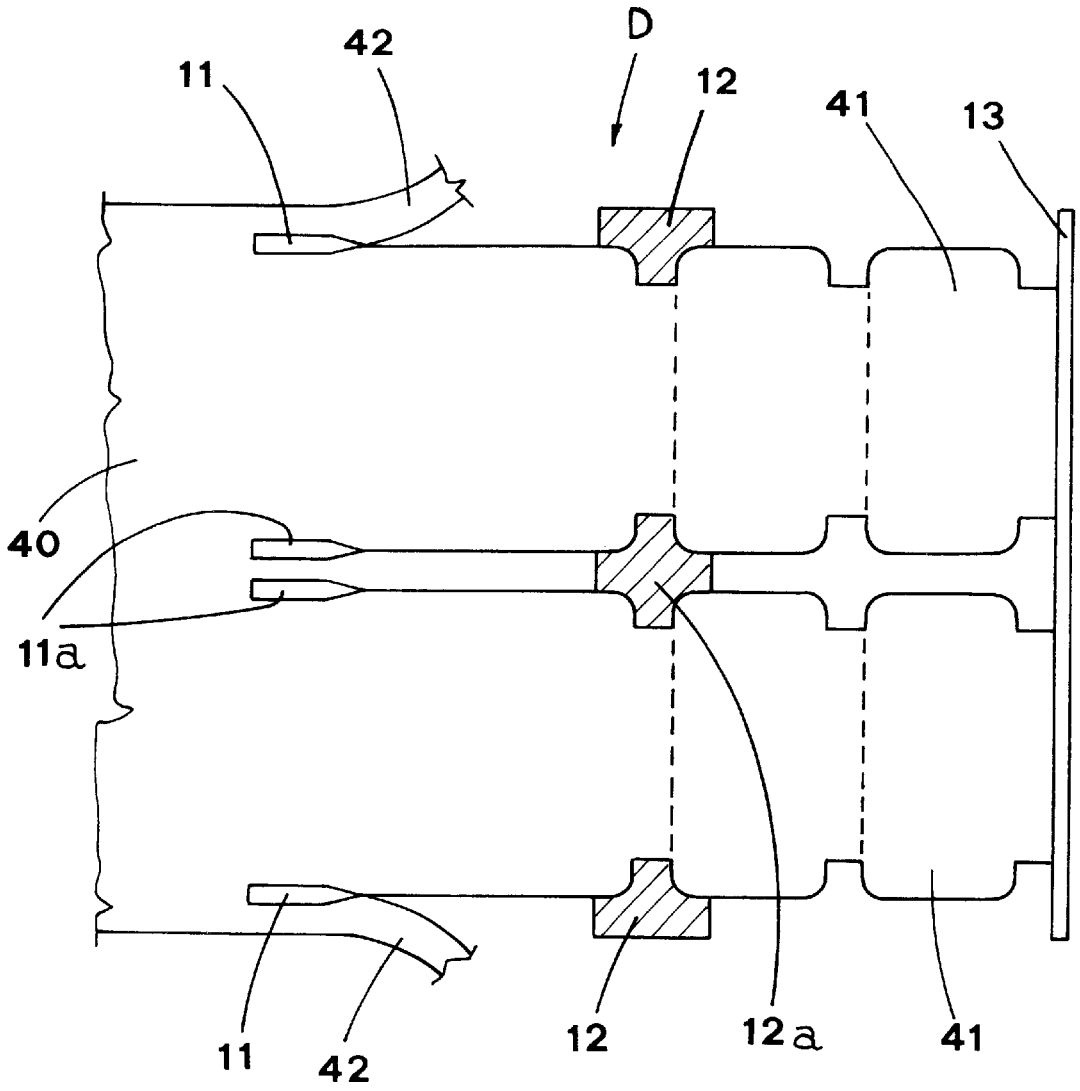
FIG. 6 is a plan view of another embodiment of the proposed device.

FIG. 6 shows another embodiment of the cutting device D, according to which a pair of blister packs 41, situated one beside the other, is obtained contemporarily from a blister band 40 of a suitable crosswise dimension. In this case, auxiliary cutting means 11*a* are associated to the cutting means 11 and auxiliary cutting elements 12*a* are associated to the cut out means 12.

The auxiliary cutting means 11*a* and auxiliary cutting elements 12*a* are situated in the region of a longitudinal middle axis of said blister band 40.

Obviously, the auxiliary cutting means 11*a* and auxiliary cutting elements 12*a* are operated simultaneously with the cutting means 11 and the cut out means 12.

The proposed cutting device allows to change size in the blister packing machines easily and rapidly.

Actually, in order to change size, it is not necessary to substitute the device means, and in particular it is not necessary to substitute the whole cutting group, as it occurs in accordance with the traditional technique, but it is enough to adjust, in an easy and rapid way, the position of the cutting means 11 and/or cut out means 12 and/or shearing means 13, which cooperate to define the blister packs 41.

The position of the cutting means 11 and/or cut out means 12 and/or shearing means 13 can be advantageously set by relative actuators, with position sensors associated thereto; in this case, the size of the blister packs 41 is changed automatically.

Actually, the proposed cutting device D is universal, as it can be used for production of blister packs of any size, within the dimensions of the band of heat-formable material. This results in productivity increase and production costs reduction.

It is understood that what above, has been described as a pure, not limitative example, therefore, possible variants of the invention remain within the protective scope of the present technical solution, as described above and claimed hereinafter.

What is claimed is:

1. A device for cutting blister packs, having a selected crosswise dimension or length, from a blister band driven in a forward direction to a shearing station of a blister packing machine having shearing means for crosswise severing blister packs on the blister band, the device comprising:

cutting means situated before said shearing means, said cutting means operated along side edges of said blister band for cutting side strips extending beyond said crosswise dimension or length of said blister packs;

cut out means situated after the cutting means and before said shearing means for cutting shaped pieces of said blister band in alignment with a cutting line of said cutting means, to define corner zones of said blister packs;

said cutting means being movable crosswise with said cut out means for adjustment of the crosswise dimension or length of said blister packs when the size of the blister packs is changed, the distance between said cut out and said shearing means being adjustable for adjustment of a lengthwise dimension or a width of said blister packs when the size of the blister packs is changed and for making the shearing means act in a region of said corner zones defined by said cut out means.

2. The device according to claim 1, wherein said shearing means are movable lengthwise relative to the blister band for adjustment of the lengthwise dimension or width of said blister packs, when the size of the blister packs is changed.

3. The device according to claim 1, wherein said cutting means include a pair of blades respectively operable on each side edge of said blister band.

4. The device according to claim 1, wherein said cut out means include a pair of cutting elements respectively operable on each side edge of said blister band and having bilateral cutting edges to make rounded corners in adjacent blister packs.

5. The device according to claim 1, wherein said shearing means include a blade operated crosswise relative to the blister band in a corner zone region defined by said cut out means, to sever single blister packs.

6. The device according to claim 1, further comprising auxiliary cutting means associated with said cutting means and auxiliary cutting elements associated with said cut out means, said auxiliary cutting means and auxiliary cutting elements being situated in a region of a longitudinal middle axis of said blister band, for producing at least two blister packs situated side by side from said blister band.

7. The device according to claim 1, wherein said cutting means are movable with said cut out means lengthwise relative to the blister band for adjustment of the lengthwise dimension or width of said blister packs, when the size of the blister packs is changed.

8. The device according to claim 7, wherein said cutting means and cut out means include separate cutting members for each side edge of said blister band.

* * * * *